United States Patent [19]

Lee

[11] Patent Number: 4,677,781

[45] Date of Patent: Jul. 7, 1987

[54] RETROFIT FIREARM

[75] Inventor: Joseph L. Lee, Woodbridge, Conn.

[73] Assignee: Mossberg & Sons, Inc., North Haven, Conn.

[21] Appl. No.: 838,623

[22] Filed: Mar. 11, 1986

[51] Int. Cl.[4] ..... F41C 17/08; F41C 7/00

[52] U.S. Cl. ..... 42/70.01; 42/70.06; 42/72

[58] Field of Search ..... 42/70.01, 70.06, 70.07, 42/71.01, 72, 75.01, 75.03

[56] References Cited

U.S. PATENT DOCUMENTS

| | | | |
|---|---|---|---|
| 1,307,594 | 6/1919 | Newman | 42/72 X |
| 1,367,996 | 2/1921 | Sussman | 42/72 |
| 3,488,488 | 1/1970 | Crouch | 42/75.01 X |
| 3,512,290 | 5/1970 | La Violette, Jr. et al. | 42/75.01 |
| 4,601,123 | 7/1986 | Swearengen et al. | 42/72 |

FOREIGN PATENT DOCUMENTS

| | | | |
|---|---|---|---|
| 101830 | of 1916 | United Kingdom | 42/72 |

*Primary Examiner*—Deborah L. Kyle
*Assistant Examiner*—Ted L. Parr
*Attorney, Agent, or Firm*—McCormick, Paulding & Huber

[57] ABSTRACT

A proven sporting type shotgun with the stock removed therefrom converted to a military combat type weapon by addition of a retrofit assembly which includes a retrofit housing containing the trigger of the basic sporting shotgun and at least a portion of the shotgun receiver. The trigger of the shotgun is operated by an elongated trigger connector assembly operably connected to a primary trigger supported on the retrofit housing forward of the shotgun trigger. The gun safety mechanism includes a blocking cam biased to a blocking position wherein it engages an abutment surface on the trigger guard of the shotgun to prevent movement of the shotgun trigger to its firing position. A cam roller carried by the trigger connector assembly cammingly engages the blocking cam during inital rearward movement of the primary trigger to move the blocking cam to a releasing position relative to the shotgun trigger. Further rearward movement of the primary trigger causes the roller cam to move the shotgun trigger to its firing position and thereby discharge the gun. The retrofit assembly further includes a grip safety and a crossbolt safety, each for blocking the primary trigger in safe position to prevent rearward movement of the primary trigger.

20 Claims, 9 Drawing Figures

RETROFIT FIREARM

BACKGROUND OF THE INVENTION

This invention relates in general to firearms and deals more particularly with improvements in a retrofit firearm of the type which comprises a proven basic firearm and a retrofit assembly which converts the basic firearm to a firearm of another type without altering the operational characteristics of the basic firearm.

The escalating incidence of suburban crime has created demand for improved home security weapons. It is generally recognized that a shotgun is more ideally suited than a handgun for use as a home defense weapon, because of the probability of a first shot hit, even in the hands of a relatively inexperienced person. The devastating effect of a shotgun at close range is well known. Consequently, an intruder is not likely to attack when confronted by a shotgun. Further, if it should be necessary to discharge the weapon in self-defense within a building, it is unlikely that the fired projectiles would retain sufficient velocity to kill or seriously wound an innocent person after passing through a wall of the building.

The relatively great length of a conventional sporting shotgun makes it difficult to handle at close range as a defense weapon. To overcome this problem retrofit assemblies have been provided which convert a conventional sporting shotgun to a weapon of military combat or battle type more ideally suited for use at close range.

A retrofit firearm of the aforedescribed general type and which the present invention is primarily concerned is illustrated and described in U.S. Pat. No. 4,601,123 of Swearengen, et al, filed Jan. 10, 1984, and assigned to O. F. Mossberg & Sons, Inc., North Haven, Conn., assignee of the present application.

The retrofit firearm disclosed in the aforementioned application comprises a basic sporting firearm or shotgun from which the stock has been removed. The essential elements of the basic shotgun, and which comprise part of the retrofit shotgun, include a receiver, which contains the gun operating or firing mechanism, a barrel which projects from the receiver and a trigger supported on the receiver for releasing the firing mechanism to discharge the gun. At least a portion of the receiver of the basic shotgun and its trigger are contained within a retrofit housing which comprises part of the retrofit assembly. The retrofit housing substantially alters the outward appearance of the basic sporting shotgun and imparts to it the configuration of a combat weapon. The retrofit assembly further includes a primary trigger and a trigger connector assembly which connects the primary trigger, used to fire the retrofit shotgun, to the trigger on the basic firearm, hereinafter referred to as the secondary trigger. Since the manually operated safety mechanism or mechanisms on the basic firearm must be disabled or removed before the retrofit housing is assembled on the basic firearm, the required safety mechanism is incorporated in and comprises part of the retrofit assembly. The present invention is concerned with improvements in retrofit firearms of the aforedescribed general type and more specifically with safety mechanisms for such retrofit firearms.

SUMMARY OF THE INVENTION

In accordance with the present invention, a retrofit firearm comprises the essential operating elements of a pre-existing basic firearm and a retrofit assembly. The essential element of the basic firearm include a receiver, a barrel projecting forwardly from the receiver, a firing mechanism contained within the receiver and a secondary trigger supported on the receiver for the movement between ready and firing positions to discharge the basic firearm. The retrofit assembly includes a retrofit housing which contains the secondary trigger and at least a portion of the receiver. The retrofit assembly further includes a primary trigger supported on the retrofit housing for movement between first and second positions and a trigger connector assembly for moving the secondary trigger from its ready to its firing position in response to movement of the primary trigger from its first position toward its second position to discharge the retrofit firearm. In accordance with the present invention, the retrofit assembly further includes a first safety mechanism which has a first blocking member associated with the secondary trigger and supported for movement between blocking and releasing positions relative to the secondary trigger. The first blocking member in its blocking position prevents movement of the secondary trigger to its firing position. The retrofit assembly also includes a releasing means for moving the first blocking member from its blocking position to its releasing position in response to movement of the primary trigger toward its second position.

DETAILED DESCRIPTION OF THE PREFERRED EMBODIMENT

Figure 1:
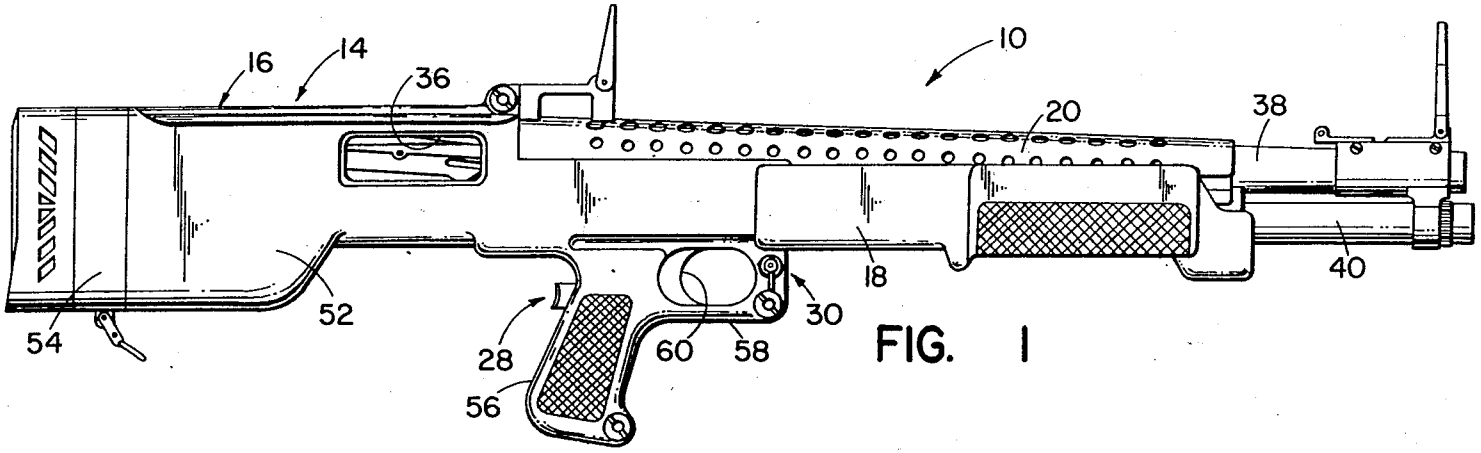
FIG. 1 is a right side elevational view of a typical retrofit firearm embodying the present invention.

Turning now to the drawings, a retrofit firearm or shotgun embodying the present invention is indicated generally by the reference numeral 10 in FIG. 1. The illustrated retrofit shotgun 10 essentially comprises a thoroughly proven basic sporting shotgun, designated generally by the numeral 12 and best shown in FIG. 2, from which the stock and forearm have been removed. A retrofit assembly indicated generally at 14 and assembled with the basic shotgun 12 converts the basic sporting shotgun to the retrofit shotgun 10, which, as shown, is of combat or military type.

Figure 2:
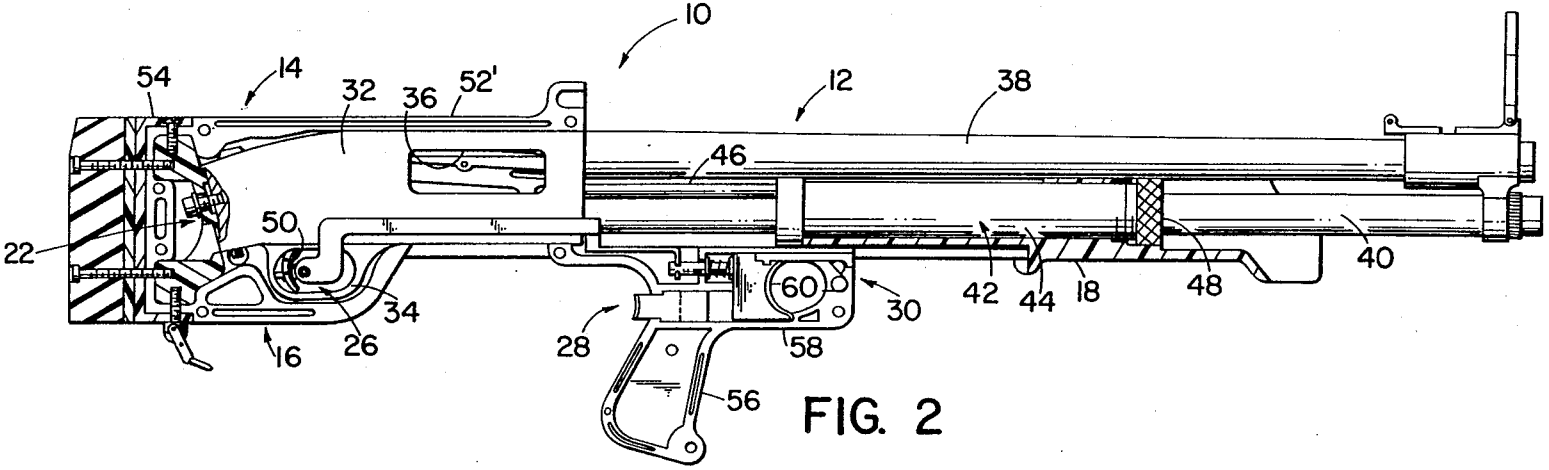
FIG. 2 is a longitudinal sectional view through the firearm shown in FIG. 1.

Referring further to FIG. 2 the retrofit assembly 14 essentially comprises a retrofit housing, indicated generally at 16, and a forearm 18 which replaces the sporting type forearm removed from the basic sporting shotgun 12. The retrofit assembly further includes a heat shield 20, a recoil beam designated generally by the numeral 22 in FIG. 2, and a trigger connector assembly or operating member, indicated generally at 24. Further, and in accordance with the invention, the retrofit assembly also has a first safety mechanism, indicated generally at 26, and second and third safety mechanisms designated generally by the numerals 28 and 30, respectively.

The housing 16, forearm 18 and heat shield 20 cooperate in assembly with each other to encapsulate a portion of the basic sporting shotgun 12 whereby to convert it from a shotgun of sporting length to a combat or military type shotgun of somewhat shorter length, more ideally suited for use as a defense or close assault weapon. The conversion is made without altering the operational characteristics of the proven sporting shotgun or requiring modification of the basic gun other than the simple elimination of parts.

The illustrated basic sporting shotgun 12 comprises a MOSSBERG 500 slide action shotgun manufactured and marketed by O. F. Mossberg & Sons, Inc., North Haven, Conn. 06473, and has a receiver 32 which includes an integral trigger guard 34 near its rear or stock end. A rectangular ejection port 36 opens through the right-hand wall of the receiver and a rectangular loading opening is formed in the bottom wall of the receiver forward of the trigger guard 34, but not shown, through which shells are loaded into the shotgun 12 in a manner well known in the art. A barrel 38 threadably connected to the receiver 33 projects forwardly from it and may be provided in various lengths and choke combinations.

The illustrated basic sporting shotgun 12 further includes a magazine tube 40 which extends forwardly from the receiver below and in parallel relation to the barrel 38. An action slide assembly, indicated generally at 42 in FIG. 2, includes a slide tube 44 slidably supported on the magazine tube 40 and a pair of action bars 46,46 (one shown) which extend rearwardly from the slide tube at opposite sides of the magazine tube and into the receiver 32 for moving a conventional bolt (not shown) contained within the receiver to and from battery position. The forward end of the slide tube 42 is threaded to receive a slide tube nut 48 which usually retains the sporting forearm in assembly with the slide tube 44. However, in the retrofit shotgun 10 the nut 38 is used to retain the forearm 18 in fixed position on the slide tube to move with it. A conventional firing mechanism contained within the receiver 32 is released to discharge the firearm 10 by a shotgun trigger 50, pivotly supported on the receiver and exposed within the trigger guard 34. In the further description which follows and in the claims the shotgun trigger 50 is referred to as the secondary trigger to clearly distinguish it from a primary trigger which forms a part of the retrofit assembly hereinafter more fully described.

The retrofit housing 16 and forearm 18 which surround the shotgun action are preferably molded from durable high-impact plastic materials to resist severe punishment. Preferably, and as shown, the retrofit housing 16 comprises a hollow clam shell housing formed by two mating housing sections 52,52' of opposite hand (one shown in FIG. 2) and a cup-shaped butt plate 54. The D housing sections 52,52' cooperate in assembly to generally compliment associated portions of the receiver 32 received therein and also contain at least portions of the barrel 38, magazine tube 40 and action slide assembly 42.

A detailed description of the manner in which the sections of the retrofit housing 16, the heat shield 20 and the recoil beam 22 are assembled with a basic sporting shotgun is found in U.S. Pat. No. 4,601,123 of Swearengen, et al which is hereby adopted by reference as part of the present disclosure. Only those details of the retrofit assembly essential to the further understanding of the invention will be hereinafter discussed.

The retrofit housing 16 has a relatively short stock portion which contains a major portion of the receiver 32, the trigger guard 24 and the secondary trigger 50. The retrofit housing 16 also defines a pistol grip 56 and an associated trigger guard 58.

Figure 3:
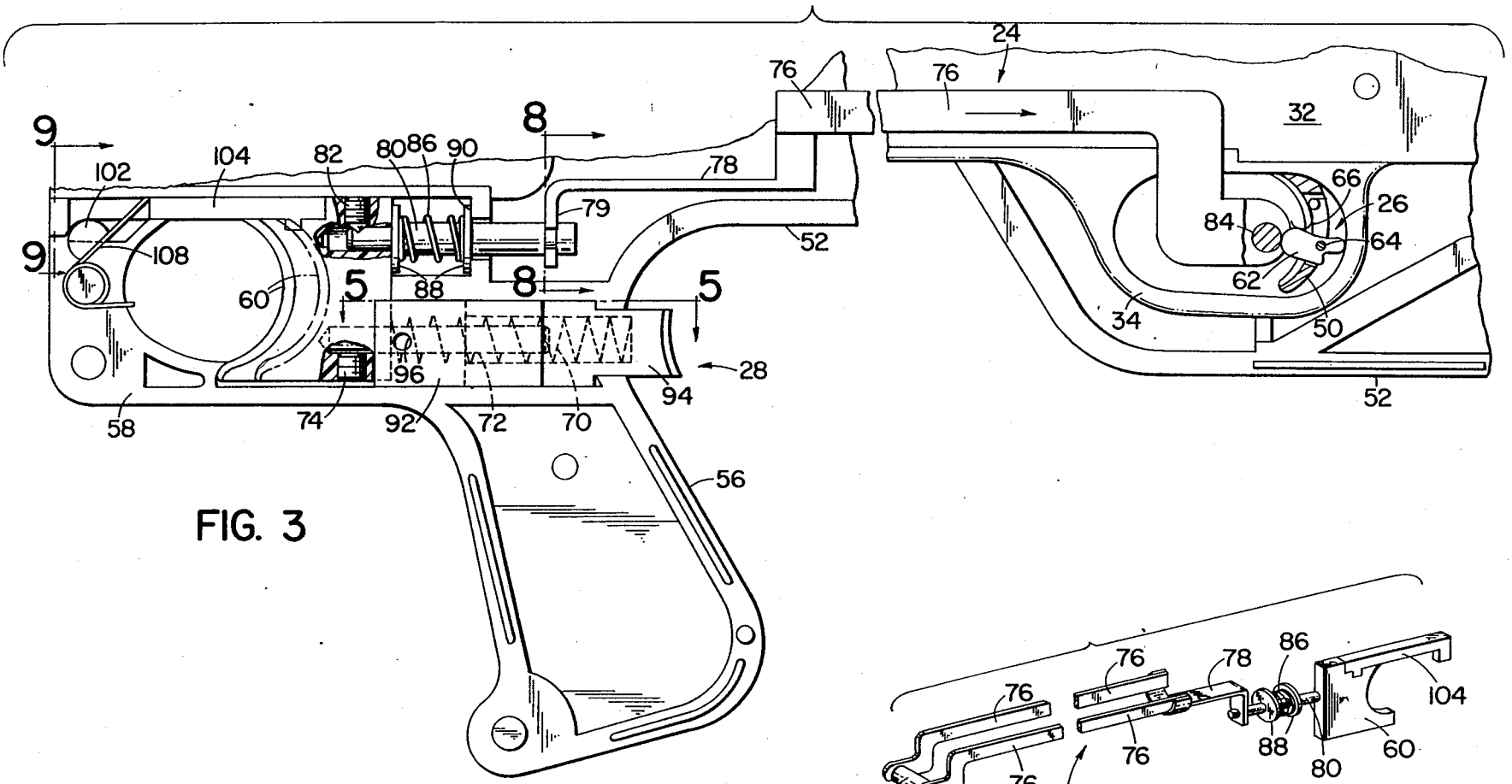
FIG. 3 is a somewhat enlarged fragmentary left side elevational view of the firearm shown with a section of the retrofit housing removed therefrom.
Figure 4:
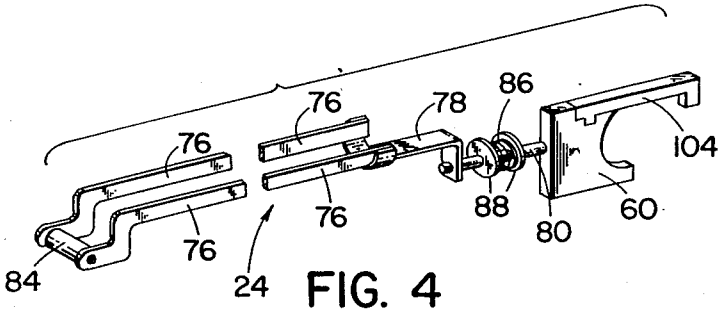
FIG. 4 is a somewhat enlarged perspective view of the trigger connector assembly.

Referring now more particularly to FIG. 3, the primary trigger indicated by the numeral 60 is supported within recesses in the trigger guard formed by the mating sections of the retrofit housing 16 for forward and rearward sliding movement between first and second positions, indicated in full and broken lines in FIG. 3, corresponding, respectively, to ready and firing positions of the secondary trigger 50. The trigger connector assembly 24 operably connects the primary trigger 60 to the secondary trigger 50 and moves the secondary trigger to firing position in response to movement of the primary trigger 60 rearwardly toward the stock portion of the housing 16, and toward its second position.

Figure 7:
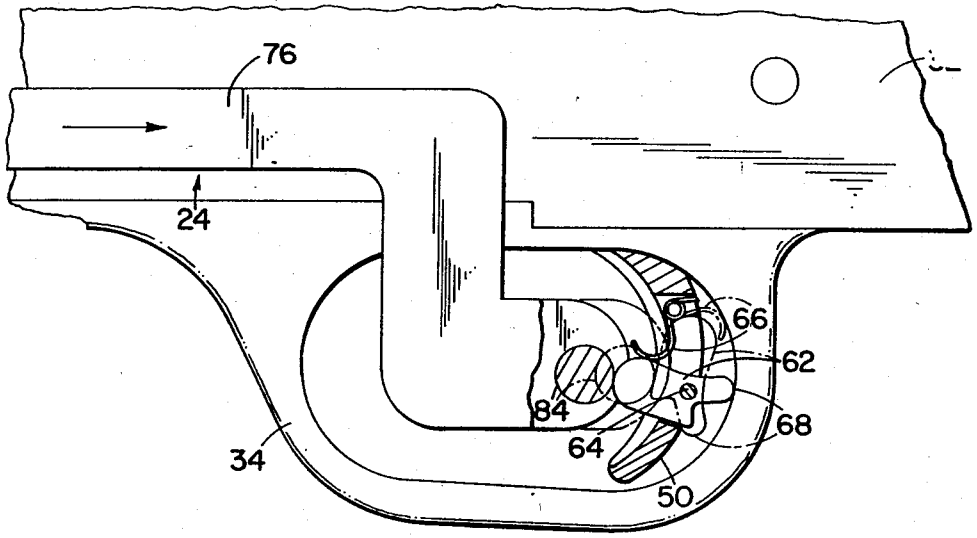
FIG. 7 is an enlarged fragmentary side elevational view similar to FIG. 3.

In accordance with the present invention, the first safety mechanism 26 prevents movement of the secondary trigger 50 toward its firing position when the primary trigger 60 is in its first position, that is the position corresponding to the ready position of the secondary trigger 50. The first safety mechanism 26 comprises a first blocking member or blocking cam 62 pivotly supported within a slot in the secondary trigger 50 by a blocking cam pivot pin 64 for movement between blocking and releasing positions relatively to the secondary trigger 50 and indicated by full and broken lines, respectively, in FIG. 7. The trigger blocking cam 62 is biased toward and held in its blocking position by a trigger cam spring 66 which acts between the secondary trigger 50 and the trigger blocking cam 62. In the blocking position a projection 68 on the blocking cam 62 engages an associated portion of an abutment surface defined by the inner surface of trigger guard 58 to prevent rearward movement of the secondary trigger 60 from its ready position toward its firing position.

Figure 8:
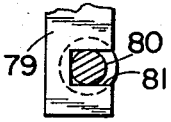
FIG. 8 is a fragmentary sectional view taken along the line 8—8 of FIG. 3.

In addition to operating the secondary trigger 50 the primary trigger 60 and its associated trigger connector assembly 24 also serve to release the first safety mechanism 26 to enable operation of the secondary trigger 50, as will be hereinafter further discussed. The trigger connector assembly 24 is formed by a pair of elongated right and left side trigger connector brackets 76,76 connected together at the forward ends thereof by a spreader 78, which has a downwardly bent forward end portion 79. The end portion 79 has a notch 81 (FIG. 8) to engage the rear end portion of a trigger pin 80 connected in fixed position to the primary trigger 60 by a trigger pin retaining screw 82, as shown in FIG. 3. The rear end portions of the trigger connector brackets 76,76 are joined together by a roller cam 84 journalled on the brackets for rotation about an axis extending in a transverse direction relative to the axis of the barrel 38. The roller cam 84 is disposed in close relationship with the blocking cam 62 when the primary trigger 60 is in its first position. A trigger return spring 86 received on the trigger pin 80 between a pair of trigger pin washers 88,88 acts between the primary trigger 60 and forwardly facing abutment surface 90 on the retrofit housing 16 to urge the primary trigger 60 in a forward direction and to its first position which corresponds to a ready position of the secondary trigger 50.

Movement of the primary trigger 60 in rearward direction or toward its second position, indicated by broken lines in FIG. 3, in opposition to the biasing force of the trigger return spring 86 causes corresponding rearward movement of the roller cam 84. Initial rearward movement of the primary trigger 60 brings the roller cam 84 into camming engagement with the blocking cam 62 supported on the secondary trigger and cams the blocking cam to its releasing or broken line position of FIG. 7. Further rearward movement of the primary trigger 60 toward its second position causes the roller cam 84 to move the secondary trigger 50 toward and to its firing position whereby the retrofit firearm 10 is discharged.

Upon release, the primary trigger 60 is returned to its first position in response to the biasing force of the trigger return spring 86. The secondary trigger 50 is returned to its ready position by a return spring or other biasing means associated with the firing mechanism and located within the receiver 32, but not shown. The blocking cam 62 also returns to its blocking position in response to the biasing force of the trigger cam spring 66 where it is held by the latter spring until such time as the firearm is again discharged by operation of the primary trigger 60.

Figure 5:
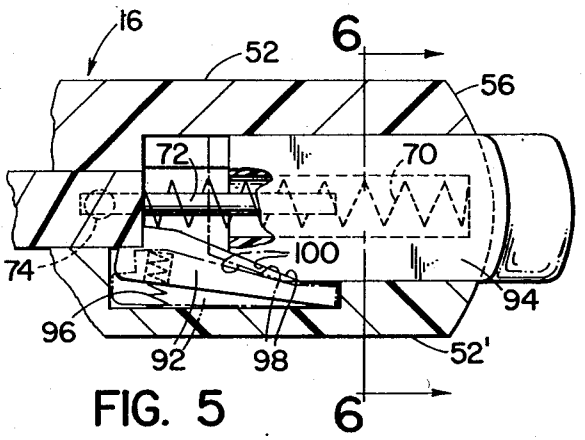
FIG. 5 is a somewhat further enlarged fragmentary sectional view taken along the line 5—5 of FIG. 3.
Figure 6:
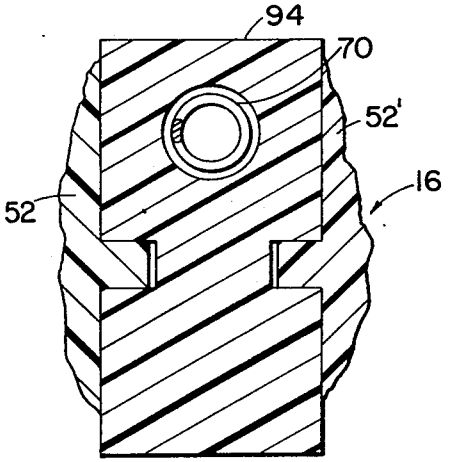
FIG. 6 is a somewhat enlarged fragmentary sectional view taken along the line 6—6 of FIG. 5.

The second safety mechanism 28 comprises a grip safety mechanism which functions to releasably retain the primary trigger 60 in its first position until gripping pressure is applied to the pistol grip 56, as when the gun is held in a firing position. Referring now particularly to FIGS. 3, 5, and 6, the second safety mechanism or pistol grip safety 28 comprises a second blocking member 92 disposed within a generally complimentary recess in the retrofit housing above the pistol grip 56 generally rearward of the primary trigger 60 and a safety grip member 94 received within another portion of the latter recess and having an operating portion which extends rearwardly through and beyond the pistol grip. The grip safety member 94 is biased in a rearward direction to project from the pistol grip 56 by a safety grip spring 70 which acts between the grip safety member 94 and the primary trigger 60. A safety grip pin 72 extends into the spring 70 and is retained in fixed position on the primary trigger 60 by a retaining screw 74, as shown in FIGS. 3 and 5.

The second blocking member 92 is biased toward a blocking position rearward of the primary trigger 60 by a trigger blocking spring 96 which urges the blocking member in a lateral direction and toward its blocking or full line position of FIG. 5. Coengagable cam surfaces 98 and 100 on the second blocking member 92 and the safety grip member 94 cause lateral movement of the second blocking member 92 to a released position out of the path of rearward movement of the primary trigger 60 when the grip safety member 94 is depressed into the pistol grip 56 by grasping the pistol grip, as when the gun is held in its usual firing position.

Figure 9:
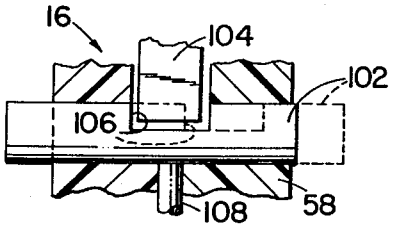
FIG. 9 is a somewhat enlarged fragmentary sectional view taken generally along the line 9—9 of FIG. 3.

The third safety mechanism 30 comprises a cross bolt safety mechanism of conventional type located in the forward portion of the trigger guard 58. The cross bolt safety mechanism has a cross bolt safety member 102, best shown in FIGS. 3 and 9, which extends transversely through the trigger guard 58 and cooperates with a forwardly projecting trigger extension 104 connected in fixed position to and extending forwardly from the primary trigger 60. The trigger extension 106 moves with the primary trigger 60 and within an associated complimentary slot formed in the upper part of the trigger guard 58.

In its "on" or safety position the cross bolt safety member 102 is disposed in blocking relation to the trigger extension 104 and prevents rearward movement of the primary trigger 60 from its first toward its second position. Lateral movement of the cross bolt safety relative to the trigger guard 58 and to its "off" or released position aligns a slot 106 formed in the cross bolt member 102 with the forward end of the trigger extension 104 to allow the trigger extension and the primary trigger 60 connected to it to move freely and in a rearward direction or toward the second position of the primary trigger 60 whereby to discharge the firearm. A cross bolt safety spring 108 disposed within an associated recess in the trigger guard 58 exerts biasing force on the cross bolt safety member 102 to frictionally retain it in one of its positions until it is manually moved to the other of its positions. Thus, the illustrated retrofit firearm 10 includes three separate and distinct safety mechanisms to prevent accidental firing.

To fire the weapon 10 the cross bolt safety member 102 must first be manually moved to its "off" or released position to release the primary trigger 60 from its positively blocked position. The pistol grip 56 must also be manually grasped to depress the grip safety member 94 which moves the second blocking member 92 laterally and out of blocking relation to the primary trigger 60. The primary trigger must also be moved from its first position toward its second position and through a sufficient distance to release of the secondary trigger blocking cam 62 from its blocking position and to move the secondary trigger 50 from its ready position to its firing position.

After the weapon has been fired and the primary trigger is returned to its first position by the trigger return spring 86. The trigger blocking cam 62 associated with the secondary trigger 50 automatically moves to its blocking or safe position so that the firearm cannot be discharged again until the primary trigger 60 is moved to its second position. Upon release of the pistol grip 56 the second safety mechanism 28 automatically moves to its safe or blocking position relative to the primary trigger 60. Thus, the first and second safety mechanisms 26 and 28 operate automatically and substantially independently of each other to safeguard against accidental firearm discharge. The third safety mechanism 30 which positively blocks the primary trigger 60 should, of course, be manually positioned in its on or "safe" position except when the weapon is to be intentionally fired.

I claim:

1. In a retrofit firearm including a preexisting basic firearm and a retrofit assembly assembled with the basic firearm, the basic firearm having a receiver, a barrel projecting from the receiver, a firing mechanism contained in the receiver and including a secondary trigger supported on and projecting from the receiver to move between ready and firing positions for releasing the firing mechanism in a firing position to discharge the basic firearm, the retrofit assembly including a retrofit housing containing the secondary trigger and at least a portion of the receiver, a primary trigger supported on the retrofit housing for movement relative to the retrofit housing between first and second positions corresponding respectively to ready and firing positions of the secondary trigger, and operating means for moving the secondary trigger to its firing position in response to movement of the primary trigger toward its second position, the improvement comprising a first safety mechanism including a first blocking member associated with said secondary trigger and movable between blocking and releasing positions relative to said secondary trigger, said first blocking member in its blocking position preventing movement of said secondary trigger to its firing position, and releasing means for moving said first blocking member from its blocking position to its releasing position in response to movement of said primary trigger toward its second position.

2. In a retrofit firearm as set forth in claim 1 the further improvement including means for urging said first blocking member to and holding it in its blocking position when said primary trigger is in its first position.

3. In a retrofit firearm as set forth in claim 2 the further improvement wherein said urging means comprises means for biasing said first blocking member toward its blocking position.

4. In a retrofit firearm as set forth in claim 3 the further improvement wherein said first blocking member is supported on said secondary trigger and said biasing means comprises a spring acting between said secondary trigger and said first blocking member.

5. In a retrofit firearm as set forth in claim 4 wherein the receiver includes a trigger guard and the secondary trigger is disposed within the trigger guard the further improvement wherein said blocking member in its blocking position is engagable with an abutment surface defined by said trigger guard.

6. In a firearm as set forth in claim 1 the further improvement wherein said operating means comprises said releasing means.

7. In a firearm as set forth in claim 6 the further improvement wherein said first blocking member is supported on said secondary trigger for movement between said blocking and releasing positions and said releasing means comprises coengageable cam surfaces on said first blocking member and said releasing means.

8. In a firearm as set forth in claim 7 the further improvement wherein said first safety mechanism includes an abutment surface on said receiver and said first blocking member in its blocking position is engageable with said abutment surface.

9. In a retrofit firearm as set forth in claim 7 wherein said operating means comprises an elongated operating member operably connected to said primary trigger and extending in the direction of said secondary trigger and supported within said retrofit housing for movement toward and away from said secondary trigger in response to movement of the primary trigger between its first and second positions the improvement comprising an operating cam carried by said operating member and defining one of said cam coengageable surfaces, said coengageable cam surfaces being in coengagement during the initial portion of travel of said primary trigger toward its second position, said one cam surface causing movement of said secondary trigger toward its firing position during the remaining portion of travel of said primary trigger to its second position.

10. In a retrofit firearm as set forth in claim 1 the further improvement comprising second safety means for releasably securing said primary trigger in a safe position to prevent movement of said primary trigger toward its second position.

11. In a retrofit firearm as set forth in claim 10 the further improvement wherein said retrofit housing includes a pistol grip associated with said primary trigger and said second safety means comprises a grip safety associated with said pistol grip.

12. In a retrofit firearm as set forth in claim 11 wherein said grip safety includes a second blocking member, means for urging said second blocking member toward a blocking position in the path of movement of said primary trigger toward its second position, and a grip safety member supported on said pistol grip for movement relative thereto between safe and released positions and projecting from said pistol grip, said second blocking member and said grip safety member having coengagable cam surfaces thereon for moving said blocking member out of the path of the said primary trigger in response to movement of said grip safety member to its released position.

13. In a retrofit firearm as set forth in claim 10 the further improvement including third safety means associated with said primary trigger for releasably retaining said primary trigger in said first position.

14. In a retrofit firearm as set forth in claim 13 the further improvement wherein said third safety means comprises a cross-bolt safety mechanism.

15. A retrofit firearm having a receiver, a firing mechanism contained within said receiver, a secondary trigger supported on the receiver to move between ready and firing positions for releasing said firing mechanism in said firing position to discharge said firearm, a retrofit housing containing at least a portion of said receiver, a primary trigger supported on said retrofit housing in spaced relation to said secondary trigger for movement between first and second positions corresponding respectively to said ready and firing positions, operating means for moving said secondary trigger to said firing position in response to movement of said primary trigger toward said second position, and a first safety mechanism associated with said secondary trigger including a first blocking member supported for movement between blocking and releasing positions, means for biasing said first blocking member toward said blocking position, said first blocking member in said blocking position preventing movement of said secondary trigger to said firing position, and releasing means for moving said first blocking member from said blocking position to said releasing position in response to movement of said primary trigger toward its second position.

16. Combination as set forth in claim 15 wherein said operating means comprises said releasing means.

17. The combination as set forth in claim 16 wherein said first blocking member is supported on said secondary trigger and said operating means is engageable with said first blocking member during initial movement of said primary trigger from its first toward its second position to move said blocking member from its blocking position to its releasing position.

18. In a retrofit firearm having essential operating elements of a basic firearm and a retrofit assembly assembled with the essential operating elements of the basic firearm, the essential operating elements including a receiver, a barrel projecting forwardly from the receiver, and a firing mechanism substantially contained within the receiver and including a secondary trigger supported on the receiver for movement between ready and firing positions corresponding respectively to ready and firing positions of the firing mechanism and having an operating portion projecting from the receiver, and a retrofit assembly including a retrofit housing containing at least a portion of the receiver and said operating portion of said secondary trigger, said retrofit assembly including a primary trigger supported on said retrofit housing in spaced relation to said secondary trigger for movement between first and second positions corresponding respectively to said ready and firing positions of said secondary trigger, and connecting means for operating said secondary trigger to discharge said retrofit firearm in response to movement of said primary trigger from its first to its second position, the improvement comprising a first safety mechanism including a blocking cam pivotly supported on said secondary trigger for movement between blocking and releasing positions relative to said secondary trigger, said blocking cam in said blocking position being disposed in blocking relation to an associated abutment surface on said basic firearm to prevent movement of said secondary trigger from its ready to its firing position, said connecting means comprising an elongated connecting member operably connected to said primary trigger and extending in the direction of said secondary trigger, said connecting member being supported within said retrofit housing for sliding movement generally toward and away from said secondary trigger in response to movement of said primary trigger between its first and second positions, said connecting member having an operating cam for engaging said blocking cam during the initial portion of travel of said primary trigger from its first position toward its second position to move said blocking cam from said blocking position to said releasing position, said operating cam being operably associated with the operating portion of said secondary trigger during the remaining portion of travel of said primary trigger from its first position to its second position whereby to discharge said retrofit firearm.

19. In a retrofit firearm as set forth in claim 18 the further improvement wherein said retrofit assembly includes means for urging said blocking cam towards its blocking position.

20. In a retrofit firearm assembly as set forth in claim 19 the further improvement wherein said urging means comprises means for biasing said blocking cam toward and holding it in its blocking position when said primary trigger is in its first position.

* * * * *